United States Patent [19]

Meshberg

[11] 4,324,351

[45] Apr. 13, 1982

[54] LOCKING ACTUATOR FOR A DISPENSER

[76] Inventor: Philip Meshberg, 85 Old Oaks Rd., Fairfield, Conn. 06430

[21] Appl. No.: 173,340

[22] Filed: Jul. 29, 1980

[51] Int. Cl.[3] ..... B65D 83/14

[52] U.S. Cl. ..... 222/402.11; 222/402.12; 222/402.13

[58] Field of Search ..... 222/153, 402.11, 402.12, 222/402.13

[56] References Cited

U.S. PATENT DOCUMENTS

| | | | |
|---|---|---|---|
| 3,180,536 | 4/1965 | Meshberg | 222/402.11 |
| 3,422,996 | 1/1969 | Lipman | 222/402.11 |
| 3,460,719 | 8/1969 | O'Donnell et al. | 222/402.12 X |
| 3,484,023 | 12/1969 | Meshberg | 222/402.11 |
| 3,608,791 | 9/1971 | Jordan et al. | 222/402.11 |
| 3,848,778 | 11/1974 | Meshberg | 222/402.11 |

FOREIGN PATENT DOCUMENTS

| | | | |
|---|---|---|---|
| 967950 | 8/1964 | United Kingdom | 222/402.11 |

*Primary Examiner*—David A. Scherbel
*Attorney, Agent, or Firm*—Kenyon & Kenyon

[57] ABSTRACT

In a dispensing actuator which includes a button rotatable between a dispensing and nondispensing position, between two stops, the button having a tab engaging the stops, to avoid overriding the stop in the dispensing position, the tab has an inwardly extending lip which abuts against the stop. The button also may include a flash burr formed on the outer circumference of the inner end of the button to frictionally engage the inside of the bore to permit automatic assembly of the actuator onto the container and valve without danger of the button falling out of the housing.

6 Claims, 5 Drawing Figures

LOCKING ACTUATOR FOR A DISPENSER

BACKGROUND OF THE INVENTION

This invention relates to atomizing dispensers in general and more particularly to an improved actuator for such a dispenser.

U.S. Pat. No. 3,484,023 discloses dispensing means, i.e., an actuator, which include means to prevent operation of the button and means to wipe and seal the nozzle or orifice in a nondispensing position so that excess dispensed material does not remain and harden and also so the material in the nozzle will not be contaminated and/or hardened due to exposure to air or the like.

This is accomplished by providing a housing, preferably a sleeve, in fixed relation to a container of material under pressure which has a control valve for controlling the dispensing of the material. The sleeve has a dispensing button rotatably and slidably mounted therein. The button has a dispensing orifice or nozzle in its side wall and an integral laterally projecting tab. The tab facilitates the rotation of the button on the sleeve between nondispensing and dispensing positions. In the dispensing position, the orifice is exposed and the button is free to move inwardly to actuate the valve to dispense material from the container. When the button is rotated (by the tab) to the nondispensing position, the nozzle engages a flexible wall on the sleeve with a wiping action and is sealed by the wall and the tab is blocked by the housing to prevent operation of the button. The wiping action of the wall removes excess material and the subsequent seal prevents any material remaining in the nozzle from being contaminated and/or hardening and clogging to interfere with subsequent dispensing operations.

The components of this design are of simple construction and assembly and can be readily molded from plastic or the like material or otherwise formed.

Furthermore, this design has found use in dispensers for eyeglass cleaner and for protective mists such as Mace. However, a problem has been found in the design presently in use. At times, it is possible for the tab to ride up over a stop which is provided for properly positioning it in the dispensing position. This, of course, makes the product less acceptable to the consumer.

A further problem with the present design relates to the assembly of the actuator onto the dispensing container. Preferably, such is done with automatic equipment. However, problems have been encountered because the button tends to fall out of the housing. This means that the button and housing cannot be transported together, thereby making the assembly operation more complex.

It is thus an object of the present invention to improve the reliability of a dispensing actuator of the type described above in such a manner that the tab will not ride up on the stop in the actuating position.

It is further object of the present invention to provide a design for this type of an actuator which facilitates automatic assembly permitting the housing and button to be conveyed and automatically applied to the valve and container during a filling operation. This, of course, should be accomplished without adversely affecting the ease of operation of the actuator.

SUMMARY OF THE INVENTION

The present invention achieves the first of the objects noted above, i.e., that of preventing the tab from overriding the stop, by forming a small triangular lip at the base of the tab which abuts against the stop even if the tab is raised enough so that it would otherwise override the stop. To accommodate this triangular lip, the housing in which the button slides is provided with a suitable recess. In addition, a bevel is provided in the housing at the edge of a recess opposite the stop to further facilitate dispensing should there be a slight mispositioning of the tab away from the stop at the dispensing position.

In order to facilitate automatic assembly, the inner lip of the button is molded with an intentionally created burr, i.e., a flash is created at this point. This small burr provides sufficient friction to prevent the button from falling out of the housing during its transport and assembly onto the valve and container. However, the friction is not great enough to in any way impair normal operation after the actuator is assembled onto the container and valve.

Although disclosed in connection with a container having material under pressure, the actuator can be used with other dispensers such as a pump dispenser.

DETAILED DESCRIPTION OF THE INVENTION

Figure 1:
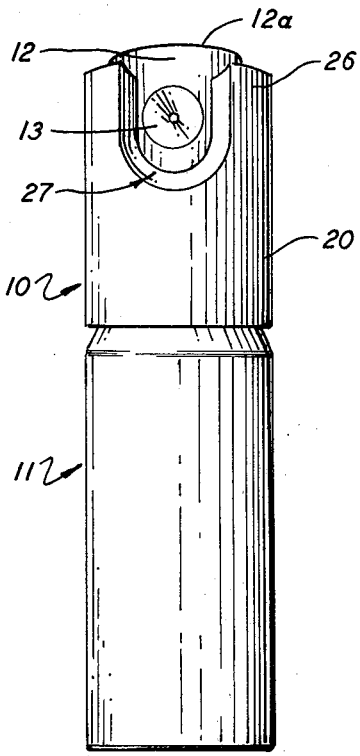
FIG. 1 is a front view of the actuator of the present invention with the button in dispensing position.

The actuator of the present invention includes a housing 10 fixedly secured to a container 11 and having a dispensing button 12 provided with a nozzle or dispensing orifice 13, which button is rotatably carried by the housing for movement between dispensing and nondispensing positions thereon. The button has means 14 (FIG. 2) connected thereto for operating a usual valve, or pump, (not shown) carried by the container for controlling the dispensing of material from the container. Hereinafter, dispensing material under pressure with a valve will be assumed. However, it will be recognized that the actuator may equally well be used with a pump dispenser. The button is normally positioned outwardly, as shown in FIG. 1, when the valve is closed. The valve is operated to dispense material from the container in response to inward axial movement of the button on the housing when in the dispensing position thereon. In the dispensing position, the orifice 13 is exposed and the button is free to reciprocate or slide on the housing. Upon rotation of the button to a nondispensing position the nozzle is moved over a flexible wall 15 on the housing which wipes excess material from the nozzle and also seals the nozzle so that material remaining therein will not be contaminated or exposed to the air and harden therein. This is particularly effective when viscous material is being dispensed.

The button has a control member or tab 16 for facilitating rotation of the button between the dispensing and nondispensing positions and in the nondispensing position the tab engages a blocking portion 17 of the housing to prevent inward movement of the button so as to operate the dispensing valve.

In the specific illustrated form of the invention the housing 10 comprises a sleeve 20 molded of a suitable thermoplastic material having a shoulder 21 and rib 22 adjacent the open end adapted to snap over the rim 23 of the container and fixedly hold the sleeve in position thereon.

Figure 2:
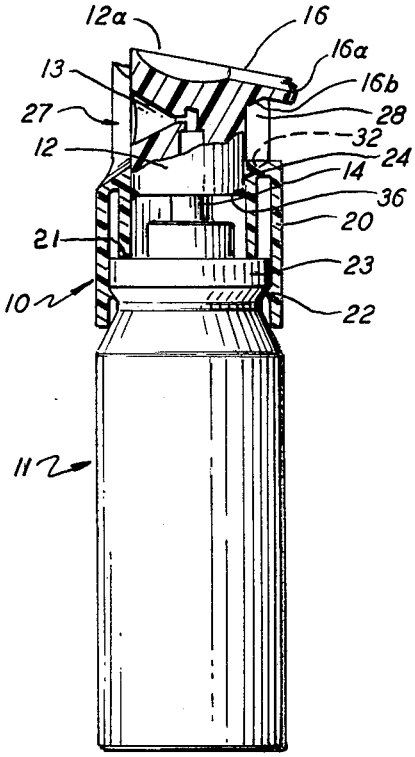
FIG. 2 is a side view of FIG. 1 partly in section.
Figure 3:
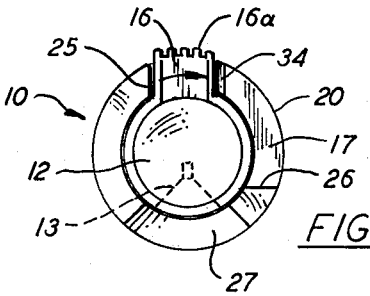
FIG. 3 is a top view of FIG. 1.

The sleeve has a bore 24 in which the button 12 is slidably and rotatably mounted. The nozzle 13 is disposed in the side of the button and the tab 16 extends laterally from the button and projects beyond the side of the sleeve as shown in FIGS. 2 and 3. Preferably, the projecting end of the tab can be provided with serrations 16*a* (FIG. 3) which facilitate the rotation of the button between dispensing and nondispensing positions. The sleeve has stops 25 and 26 (FIGS. 3 and 5) formed thereon for engaging the tab and limiting the rotation of the button in either of the two positions.

Figure 5:
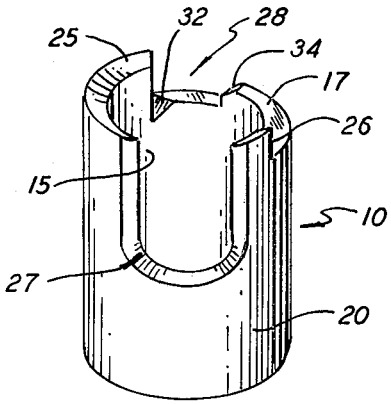
FIG. 5 is a perspective of the sleeve or housing.

When the button is turned to the dispensing position, the sleeve, in order to expose the nozzle 13, has a relatively large elongate opening or slot 27 in the side wall thereof as shown in FIG. 1. Also the sleeve has an elongate open ended slot 28 disposed in the opposite wall thereof, as shown in FIGS. 2 and 5, to receive the tab 16 as the button is moved inwardly, in response to pressure applied to the end wall 12*a*, to operate the valve on the container to dispense material.

Figure 4:
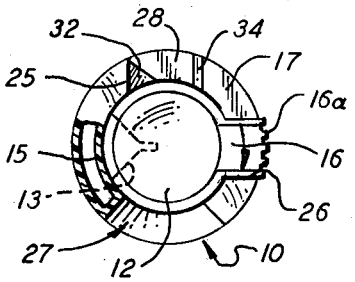
FIG. 4 is a view similar to FIG. 3, partly in section, showing the button in nondispensing position.

After a dispensing operation, pressure is removed from the button and it returns to its outward position. Then the tab is engaged and the button turned until the tab contacts the stop 26 and locates the button in the nondispensing position as shown in FIG. 4. In this position the tab will overlie the portion 17 of the sleeve adjacent the slot 28 which will block any inward movement of the button and prevent accidental operation of the valve. Also, as an incident to the movement of the button to the nondispensing position, the nozzle will be moved into engagement with the flexible wall 15 formed on the sleeve adjacent the opening 27. The engagement of the wall with the nozzle is a wiping one which will remove any excess material from the nozzle and the wall will also seal the nozzle so that any material therein will not be contaminated or harden and clog the nozzle.

What is been described so far, is an actuator of the general type described in the aforementioned in the U.S. Pat. No. 3,484,023 and a device which has been in use for a number of years. As noted above, a problem can occur in this prior art device. Under some conditions, the tab 16 tends to override the stop 25 which is located to maintain it in the dispensing position over the slot 28. In accordance with the present invention, in order to overcome this difficulty, a triangular lip 16*b* is formed on the inner side of the tab 16. This downwardly extending lip thus will abut against the wall of the slot 28 at the stop 25 even if the tab is raised an additional amount where it would otherwise override the stop. In order to accommodate this lip, when the button 12 is moved inwardly to dispense material, a cutout 32 is formed at the base of the slot 28 to receive the triangular lip.

In addition, a bevel 34 is formed at the edge of slot opposite the stop 25. As a result, a slight mispositioning of the tab 16 to the right as seen in FIG. 3 will not prevent inward movement. The edge of the tab will slide down on the bevel 34 into the slot 28.

In order to facilitate automatic assembly a burr 36 is created by a flash at the inner end of the button 16. As noted above, this creates sufficient friction between the button 16 and the housing 10 to permit the actuator to be transported and automatically applied to the valve 14 and container 11. At the same time, friction is not great enough to impede the dispensing action or the return of the button to the position shown in FIG. 2 under the force of the return spring of the valve 14.

As will be noted from the drawings, the structure of the present invention is simple, can be readily made by molding, or otherwise forming, preferably plastic material, can be easily assembled and operated, and is highly efficient.

What I claim is:

1. In an actuator for dispensing material from a container, having means for controlling the dispensing of the material from the container, comprising:

(a) a housing provided with means to be fixedly secured to the container, and a bore extending therethrough;

(b) a dispensing button disposed within said bore and surrounded by the housing, said button being slidably and rotatably mounted within the bore and having a dispensing orifice on one side and located within the bore, an actuating portion for operating the dispensing means in response to inward movement of the button, said button having a control member on the opposite side thereof from said orifice and projecting laterally over the end of said housing and adapted to facilitate rotation of said button, said button being rotated in the housing by said control member between dispensing and nondispensing positions;

(c) stop means on the housing engaging said control member for limiting rotation in said positions;

(d) said housing in the dispensing position having an opening to expose said orifice and in nondispensing position of the button having a wall within the bore adjacent said opening; and (e) said housing, in the dispensing position of the button, having means to receive the control member to enable the button to be moved inwardly to dispense material and in the nondispensing position having an end wall disposed under the control member to prevent dispensing, the improvement comprising:

(f) an inwardly extending lip formed on the inward edge of said control member, said lip being in abutting relationship with the stop means on said housing when in said dispensing position, for limiting rotation to the dispensing position, to prevent said control means from overriding said stop; and (g) said means to receive the control member having formed therein a recess for receiving said extended lip.

2. The improvement according to claim 1 wherein said control member is integral with said button and extends laterally beyond the housing and has means on the end of said control member to facilitate rotation of said button between said positions in said housing.

3. The improvement according to claim 2 wherein said means on the housing to receive said control member in the dispensing position comprise an elongated axially extending slot formed in the side of said housing to engage said control member when in the dispensing position to permit it to move inwardly, said recess for said extending lip formed at the base of said slot, one wall of said slot forming the stop means for engaging said control member for limiting rotation in said dispensing position.

4. The improvement according to claim 3 and further including a bevel at the outer end of the other wall of said slot opposite said one wall forming said stop.

5. The improvement according to claim 3 and further including a burr formed at the inward edge of said button, whereby said burr will frictionally engage the bore in said housing to thereby permit automatic assembly of said actuator onto the container without the danger of said button falling out of said housing.

6. In an actuator for dispensing material from a container having means for controlling the dispensing of material from the container comprising a housing provided with means to be fixedly secured to the container, and a bore extending therethrough, a dispensing button disposed within said bore and surrounded by the housing, said button being slidably and rotatably mounted within the bore and having a dispensing orifice on one side and located within the bore, an actuating portion for operating the dispensing in response to inward movement of the button, said button having a control member on the opposite side thereof from said orifice and projecting laterally over the end of said housing and adapted to facilitate rotation of said button, said button being rotated in the housing by said control member between dispensing and nondispensing positions, stop means on the housing engaging said control member for limiting rotation in said positions, said housing in the dispensing position having an opening to expose said orifice and in the nondispensing position of the button having a wall within the bore adjacent said opening, and said housing in the dispensing position of the button having means to receive the control member to enable the button to be moved inwardly to dispense material and in the nondispensing position having an end wall disposed under the control member to prevent dispensing, the improvement comprising a burr formed on the outer circumference of the inner end of said button, whereby said burr will frictionally engage the bore in said housing to thereby permit automatic assembly of said actuator onto the container and valve without the danger of said button falling out of said housing.

* * * * *